United States Patent [19]

Landwehr et al.

[11] Patent Number: 4,664,045

[45] Date of Patent: May 12, 1987

[54] SEWING MACHINE FOR PRODUCING AN EDGE-PARALLEL SEAM

[75] Inventors: Günter Landwehr, Bielefeld; Horst Meyer, Bad Salzuflen, both of Fed. Rep. of Germany

[73] Assignee: Kochs Adler AG, Bielefeld, Fed. Rep. of Germany

[21] Appl. No.: 863,928

[22] Filed: May 15, 1986

[30] Foreign Application Priority Data

May 30, 1985 [DE] Fed. Rep. of Germany ..... 3519316

[51] Int. Cl.[4] ..... D05B 35/10; D05B 39/00

[52] U.S. Cl. ..... 112/153; 112/121.12; 112/308

[58] Field of Search ..... 112/308, 153, 121.12

[56] References Cited

U.S. PATENT DOCUMENTS

| | | | |
|---|---|---|---|
| 3,739,733 | 6/1973 | Schramayr | 112/121.12 |
| 3,911,839 | 10/1975 | Waldman et al. | 112/153 X |
| 3,913,507 | 10/1975 | Pollmeier | 112/153 |
| 4,498,407 | 2/1985 | Landwehr et al. | 112/237 |

*Primary Examiner*—Henry S. Jaudon
*Assistant Examiner*—Andrew M. Falik
*Attorney, Agent, or Firm*—Max Fogiel

[57] ABSTRACT

A sewing machine for the generation of an edge-parallel seam in a workpiece with at least one projecting zone. The sewing machine has an edge-guide member, a supporting surface, a presser foot and a feeding device for the workpiece. The edge-guide has two stop members arranged laterally and in front of and behind the needle viewed with respect to the feed direction. The stop members are relocatable into various positions. At least one of the stop members is additionally relocatable into a lifted position with respect to the supporting surface.

15 Claims, 21 Drawing Figures

Fig. 8
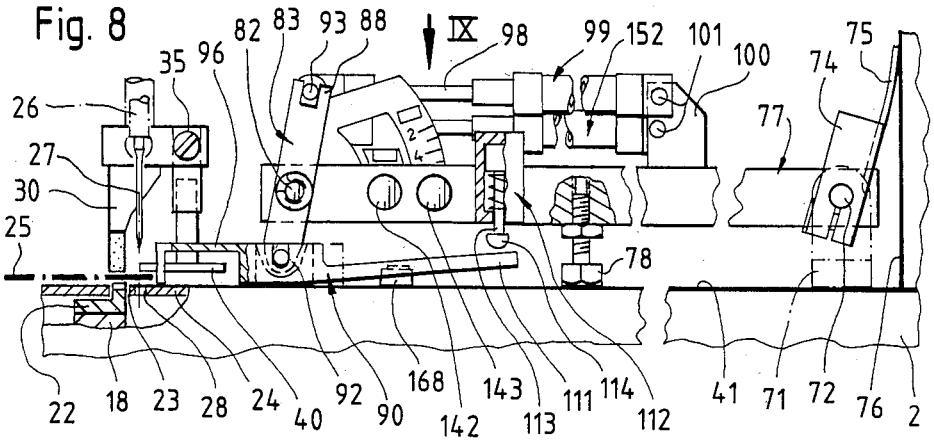
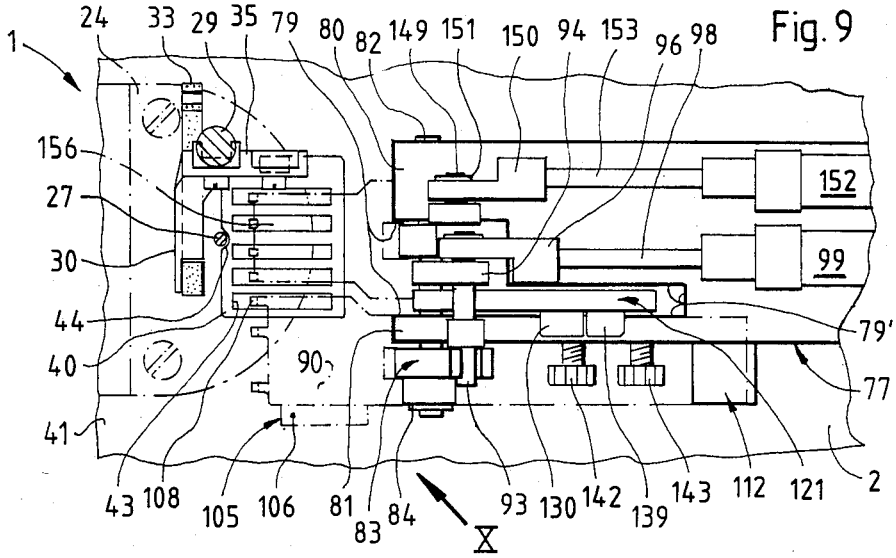
Fig. 9
Fig. 11
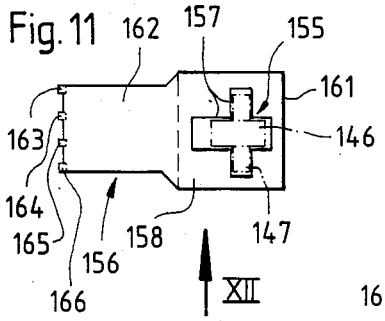
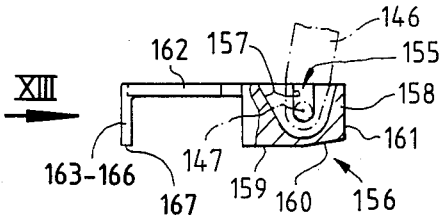
Fig. 12
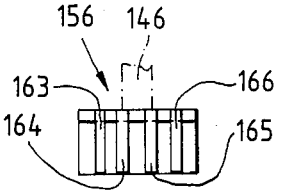
Fig. 13

Fig. 14
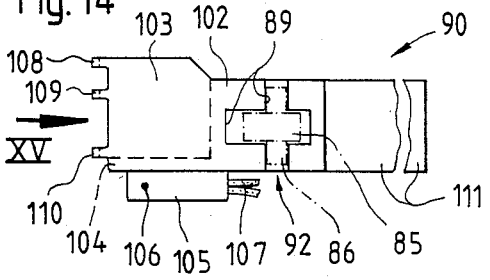
Fig. 15
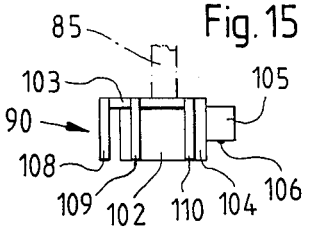
Fig. 16
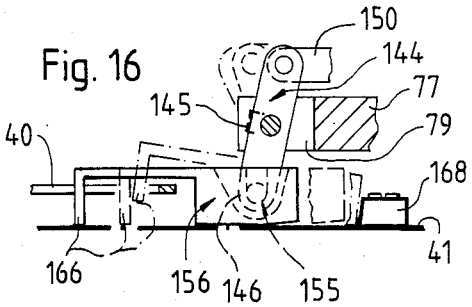
Fig. 17
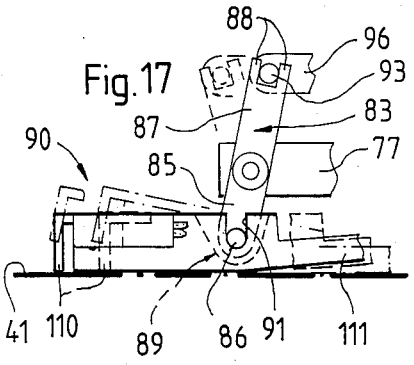
Fig. 18a
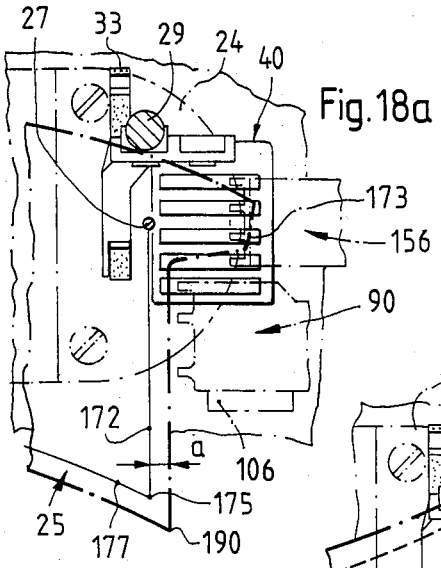
Fig. 18 b
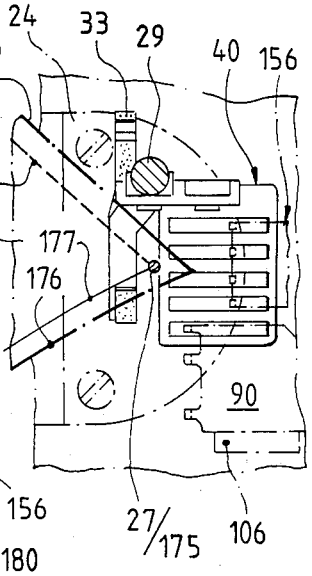
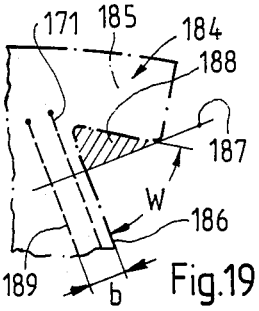
Fig.19
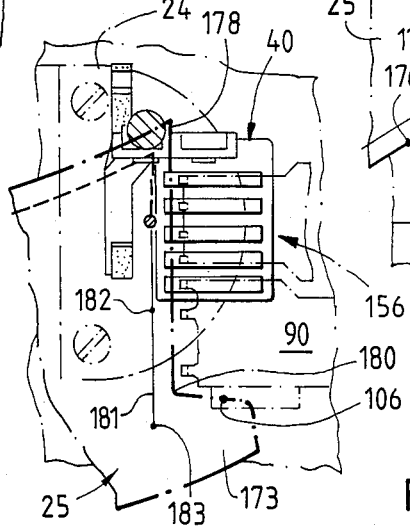
Fig. 18c

SEWING MACHINE FOR PRODUCING AN EDGE-PARALLEL SEAM

BACKGROUND OF THE INVENTION

The present invention relates to a sewing machine for producing an edge-parallel seam in a workpiece. In particular, the sewing machine is installed with a supporting surface and a presser foot for the workpiece, a stitching needle, a feeding device for advancing the workpiece in a feed direction relatively to the needle, and edge guide means laterally arranged with respect to said needle and with respect to said feed direction. The edge guide means incorporates guide members that are relocatable.

A sewing machine of such type is known by an English specification sheet (Adler-Automation 961-24-1, SpP 2412-E-x-0184-Ti-3). This sewing machine is employed for the sewing or the top-stitching of small parts as shirt cuffs and collars. Such small parts will be provided with edge-parallel seams, wherein the distance between the seam and the edge—also known as stitch width—is mechanically pre-adjustable.

Small parts of the aforementioned type can be profiled with corners. For stitching such corners it is known from the conventional sewing process to bring the needle in its lowest position at the standstill of the machine, lift the presser foot and subsequently tilt the workpiece about the needle until the following edge of the workpiece is again parallelly aligned with respect to the feed direction initiated by the feeding device of the sewing machine. In order to accomplish this tilting about the needle without hindrance of the tip of the workpiece corner by the edge guide, e.g. the stop, it is already known from the German Auslegeschrift No. 1 049 678 to displaceably arrange such stop and to carry out the relocation of this stop by a solenoid, which is controllably connected with the lifting of the presser foot.

In the first-mentioned sewing machine there is employed a control, in which there is integrated the control of the operation description above in order in accomplish the tilting of the workpiece about the needle without difficulty. Moreover, this known sewing machine renders possible the generation of different parallel seams having different seam widths. For this purpose there can be adjusted two different values of width, i.e. distances between the individual seam and the outer edge of the workpiece. At the actual sewing operation this different width can be called off by a program selection of the control.

The foregoing details of the generation of parallel seams or the operation for tilting of a workpiece at its corner is rendered possible, by equipping the sewing machine with two individually controllable edge guide members, which are laterally arranged of the needle and which are relocatable by means of controllable pneumatic cylinders. Moreover, it is possible to relocate the edge guide member situated in a farmost position seen in sewing direction, behind the needle, into three positions as the outer edge guide member is relocatable into two positions. Due to the relocation of the edge guide members in the close vicinity of the supporting area of the workpiece, it is required to displace the edge guide members over a relative large distance in order to render possible the sewing of workpieces having a zone at the starting point or the end point of a seam provided with a projecting section. A typical example of such a workpiece is represented by the so-called one-piece collar of a shirt or a blouse.

One-piece collars differ from the two-piece collar in that the band-formed portion, which later will surround the neck of a person, forms "one-piece" together with another collar part, the so-called upper collar, as the two-piece collar is composed of two pre-manufactured parts.

Due to the projecting areas, as described, it is required to bring one of the edge guide members out of the tilting zone of the workpiece. At collars, the projecting area—also called the beak of the collar—can project up to 2.5 cm with respect to the outer edge of the workpiece, so that it is time-consuming to withdraw or to relocate the edge guide members at sewing machines of the known type having an automatic sequence of operations. Moreover, styles of collars are subject at a high rate to influences of fashion, so that it may occur that the angle formed by the beak of the collar and the outer edge of the collar is less than 90°. Due to this geometric feature, it is not possible to withdraw an edge guide member operating in close contact with the supporting surface, if the edge guide member got caught behind the beak of the collar at the termination of the seam.

Moreover, the top-stitching of one-piece collars is associated with difficulties, as the workpiece of such a special type has a projecting area at the seam start and the seam end. Due to this feature is is required to relocate or withdraw the one or the other edge guide member at the start or the end of the seam to be produced out of the operating zone of the projecting area.

SUMMARY OF THE INVENTION

It is a principal object of the invention to provide a sewing machine of the above-described type, which makes it possible to efficiently produce edge-parallel seams in a workpiece having at least one projecting area with respect to the workpiece edge at the beginning or the end of a seam to be produced.

A further object of the present invention is to provide a sewing machine which allows the generation of edge-parallel seams in a workpiece according to the aforementioned features, which is simple in design and reliable in operation.

With the sewing machine according to the present invention, it is possible to remove or withdraw obstructing edge guide members in a minimum of time out of the operating zone of the workpiece.

According to another feature of the present invention, it is possible to remove an edge guide member out of the operating zone of projecting areas of the workpiece regardless of their specific geometric configurations.

According to other features of the invention it is also possible to produce edge-parallel seams in a workpiece that is provided with a projecting area at the starting point of the seam and is also provided with a projecting area at the final point of the seam.

Other objects, advantages and features of the present invention will appear from the detailed description of the preferred embodiment, which will now be explained in conjunction with the accompanying drawings.

BRIEF DESCRIPTION OF THE DRAWINGS

FIG. 8 is a front view of the assembly shown in FIG. 2 according to the arrow VIII, on a reduced scale;

FIG. 9 is a top plan view of an assembly illustrated in FIG. 8, according to the arrow IX;

FIG. 11 is an illustration of a single part of the assembly as shown in FIG. 9;

FIG. 12 is a side elevation of the part according to the arrow XII in FIG. 11;

FIG. 13 is a side elevation of the part according to the arrow XIII in FIG. 12;

FIG. 14 is an illustration of a further part shown in the assembly of FIG. 9;

FIG. 15 is an illustration of the part as shown in FIG. 14 according to the arrow XV in FIG. 14, while, however, turned around by 90°;

FIG. 16 shows a partial area of the assembly shown in FIG. 8, on an enlarged scale;

FIG. 17 is a view corresponding to that of FIG. 16 of further parts;

FIGS. 18*a* to *c* are views onto the stitch forming area corresponding to a part of FIG. 9, wherein the workpiece in form of a shirt collar is illustrated in different positions with respect to the sewing machine; and FIG. 19 shows a partial area of a sewn workpiece in form of a one-piece collar provided with a double edge-parallel seam.

DESCRIPTION OF THE PREFERRED EMBODIMENTS

Figure 1:
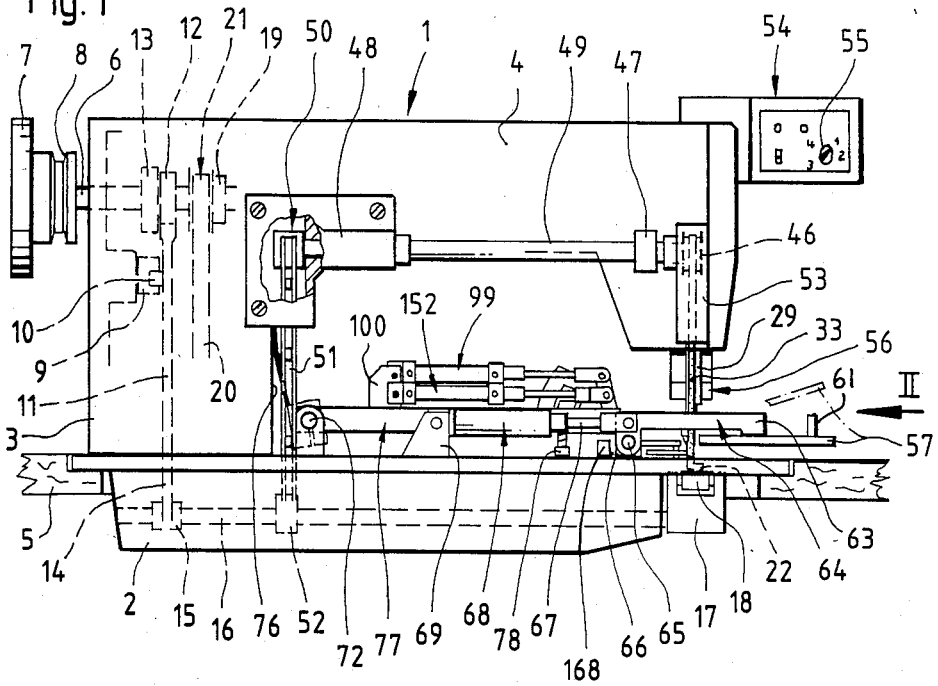
FIG. 1 shows a rear view of the sewing machine according to the present invention.

A sewing machine 1 is provided with a base plate 2, to which is firmly connected a standard 3, that ends in an arm 4 extending in parallel to the base plate 2. The base plate 2 is supported in a working plate 5. In the arm 4 there is rotatably received an arm shaft 6, which is provided, at its end reaching out of the standard 3 with a handwheel 7. The handwheel 7 is in a common manner formed with a pulley 8, which is a part of a belt drive (not shown) for driving the sewing machine 1. In the interior of the standard 3 there is adjustably received a guide way 9, in which a stitch length regulating fork 11 is pivoted by means of a slide connection 10. The upper end 12 of this stitch length regulating fork 11 is profiled with a fork and embraces an eccentric 13 fastened on the arm shaft 6. The lower end 14 of the stitch length regulating fork 11 is pivotally connected with an off-drive crank 15, which is fastened to a shaft 16 rotatably received or pivoted in the base plate 2 and extending parallel to the arm shaft 6. The shaft 16 extends out of the end of the base plate 2 turned away from the standard 3, and carries here a crank 17 pivotally receiving a feed bar 18.

Moreover, on the arm shaft 6 there is fastened a timing belt pulley 19 in the area of the standard 3. The timing belt pulley 19 receives a timing belt 20, which extends downwardly through the interior of the standard 3 from the armshaft 6 to the base plate 2. Here the timing belt 20 is operably connected in usual manner by a further timing belt pulley (not shown) to a further shaft (not shown) pivoted on the base plate 2. The timing belt pulley 19 and the timing belt 20 are parts of a timing belt drive 21. Upon rotation of the armshaft 6, a so-called four motion movement is generated at a feed dog 22 due the superposition of an oscillating movement induced at the stitch length regulating fork 11, and the rotary movement induced by the timing belt drive 21 at the shaft (not shown) pivoted in the base plate 2. The feed dog 22 is carried by the feed bar 18, and extends through cutouts 23 of a throat plate 24 screwed onto the base plate 2.

The armshaft 6 pivotally received in the arm 4 terminates in the free end of the latter in a commonly usual and known crank drive (not illustrated). This serves for the drive of a needle bar 26 with a needle 27. The needle 27 is aligned flush with a stitchhole 28, which is provided in the throat plate 24. For the generation of a double lockstitch, a hook cooperating with the needle 27 and installed with a thread cutting mechanism is provided underneath the throat plate 24.

Figure 10:
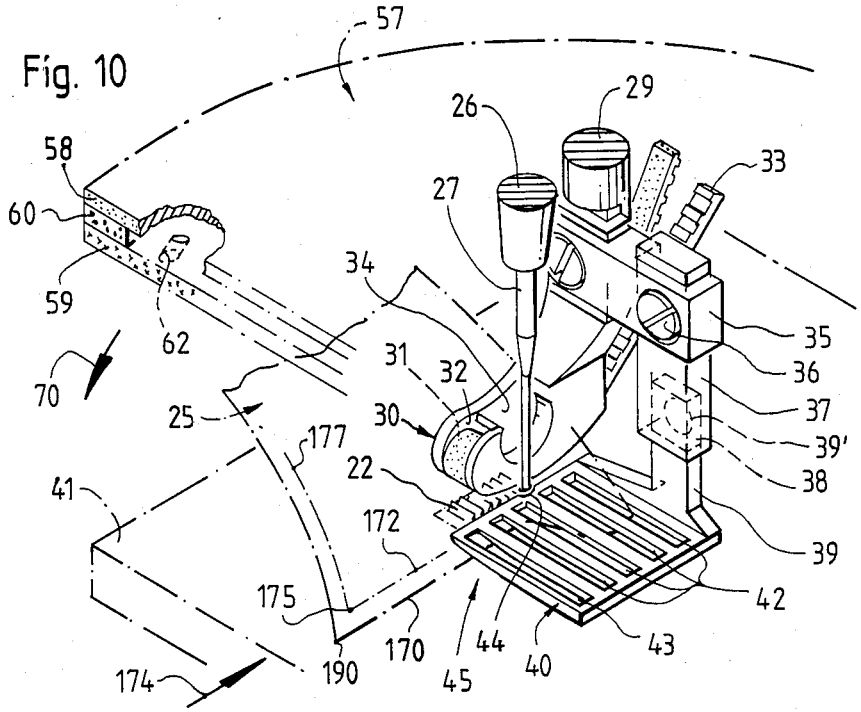
FIG. 10 is a perspective illustration of the seam generating area of the sewing machine according to the arrow X in FIG. 9.

In the end of the arm 4 there is displaceably received a presser bar 29 in parallel to the needle bar 26 (FIG. 10). To the lower end of the presser bar 29 is secured a presser foot 30 by use of a screw. The latter is profiled with a guide roller 31 and a groove 32 for receiving a timing belt 33. The presser bar 29 is surrounded by a compression spring (not shown), which rests at a wall of the arm 4, on one hand, and abuts against the presser bar 29, on the other hand, so that the presser foot 30 together with the timing belt 33 will be forced against the base plate 2. As further evident from FIG. 10, the presser foot 30 is formed so that the timing belt 33 together with the feed dog 22 acts onto the workpiece 25, wherein both, the timing belt 33 and the feed dog 22 are arranged flush with respect to each other (FIG. 8). According to FIG. 10, the presser foot 30 is, furthermore, formed with a recess 34 which makes possible the operation of the needle 27 without interference. As also evident from this illustration, a connecting part 35 is fastened together at one end with the presser foot 30. The connecting part 35 extends parallel to the longitudinal extension of the base plate 2 and carries, at its free end in a positive manner, a web 37 secured by a screw 36. The web 37 extends parallel to the presser bar 29 and has at its end, turned towards the base plate 2, a cutout 38 for receiving a lug 39. The latter is adjustably fastened by a screw 39′ in the cutout 38. The lug 39 terminates in a grid-profiled sole 40, which extends in parallel to the supporting surface 41 of the base plate 2 according to FIG. 8. According to the embodiment, the sole 40 is formed with five cutouts in total. Four of these cutouts are denoted according to FIG. 10 with the Ref. No. 42, and the fifth cutout is denoted with the Ref. No. 43. As further evident from the perspective elevation of FIG. 10, the sole 40 is taperingly formed towards the zone of stitch formation at the side turned towards the supporting surface 41. Moreover, the sole 40 is formed with a semi-circular-formed clearance cut 44, so that the needle 27 can pass unobstructed, on one hand, and so that the workpiece 25 to be stitched is kept in position as close as possible at the needle 27, on the other hand. In connection with the presser foot 30, the sole 40 forms a press pad 45 holding down the workpiece 25 when the needle 27 rises.

The timing belt 33 is drivingly connected to a gear 46, which is firmly connected to one end of a shaft 49 pivoted on bearings 47, 48 at the arm 4. The free end of the shaft 49 reaches into a non-illustrated overrunning element with laterally arranged bearings (type Torrington). Such constructions are, for example, known from U.S. Pat. No. 4,271,776. The overrunning element is received in a crank 50, which is drivingly connected with a further crank 52 by a tie rod 51. The crank 52 is received on the shaft 16 and is oscillatably driven by the stitch length regulating fork 11. The crank 50, 52 are each pivotally connected with the tie rod 51. As also evident from FIG. 1, the shaft 49 is axially secured by the crank 50 or the gear 46. On the shaft 49 there is rotatably received a tilt lever 53 in the zone of the gear 46. The tilt lever 53 is formed with guide rollers (not shown) which guide portions of the timing belt 33 extending from the presser foot 30 to the gear 46. By means of a further link connection (not shown) of the presser bar 29 with the tilt lever 53, there is assurance that the timing belt 33 remains tensioned at the ascending and the descending of the presser bar 29 with respect to the supporting surface 41 of the base plate 2. At the inside of the free end of the arm 4, there is still provided a lifting drive for lifting the presser bar 29 against the force of the above-mentioned compression spring. The lifting drive is formed as a pneumatic cylinder and is controllable by a control system (not further described) with the assistance of a control 54 arranged at the sewing machine 1. The control 54 is provided with a program selecting switch 55, with which different sewing programs are activatable. Moreover, at the free end of the arm 4 there is fastened a group of light barriers 56, which is connected with the control 54 and which serves for the automatic operation of the sewing machine 1.

According to FIGS. 1 and 10, the sewing machine 1 has, furthermore, a turning device 57. This is comprised of two plates 58, 59 extending semi-circularly about the needle 27 and united to a hollow body in conjunction with a gasket 60. The plate 58 is formed with a tubular nipple 61, which serves for the supply of pressurized air. Moreover, the plate 59 is profiled with a plurality of outlet openings 62, each of which extends tangentially with respect to a connecting line drawn from an outlet opening 62 to the needle 27. The turning device 57 is connected with an arm 63 of an angle lever 64, which is tiltably pivoted to the base plate 2 through an axle 65 and a bearing 66. Moreover, the arm 63 of the angle lever 64 is pivotally connected with a piston rod 67 of a tilt drive 68 in form of a double acting pneumatic cylinder, which is pivotally received at a bearing block 69 of the base plate 2. At corresponding pressurization of the tilt drive 68 with pressurized air, a relocating of the turning device 57 into the lower or lifted up position is possible. In FIG. 1 the lowered position of the turning device 57 is illustrated with solid lines. The lifted up position is illustrated by dash-dotted lines.

At a pressurized air supply through the nipple 61, air gets between the plates 58, 59 and finally exhausts out of the outlet openings 62, so that the workpiece 25 positioned underneath the turning device 57, will be tilted in the direction of the arrow 70 about the center of the needle 27. In FIG. 18*b* the direction of the arrow 70 extends opposite to the clockwise direction. The pressurized air supply of the turning device 57 will be also controlled by the aforementioned control system with the assistance of the control 54. To this point, sewing machine 1, as described, is known from the German Offenlegungsschrift 32 16 995 (corresponding to U.S. patent application Ser. No. 491,266 U.S. Pat. No. 4,498,407).

Figure 2:
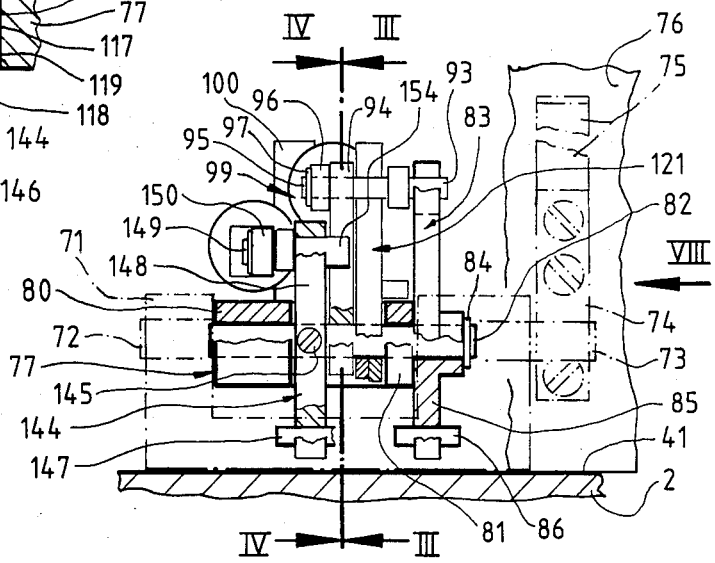
FIG. 2 is a side elevation of an assembly essential for the invention according to the arrow II in FIG. 1, on an enlarged scale.

On the supporting surface 41 there is provided a U-profiled bearing 71 (FIG. 2) having two shanks which pivotally receive a shaft 72. The latter extends parallel to the supporting surface 41, and perpendicular with respect to the longitudinal extension of the arm shaft 6. The shaft 72 is provided with a projecting end 73 extending towards the front side of the sewing machine 1. Onto the end 73 there is secured a clamping member 74. To the clamping member 74 there is fastened a leaf spring 75 by screws (not shown). The free end of the leaf spring 75 rests on an outer surface 76 of the standard 3 directed towards the needle 27 (FIGS. 2, 8). Between the shanks (not shown) of the bearing 71, there is arranged a lever 77 on the shaft 72. The lever 77 and the shaft 72 are firmly connected with another, so that it is possible to generate a torque opposite to clockwise direction by the force of the leaf spring 75 and the lever 77, at an appropriate setting of the clamping member 74 and the shaft 72. Due to this torque the lever 77 abuts against the supporting screw 78 arranged at the supporting surface 41 of the base plate 2 (FIG. 8). With the adjustability of the supporting screw 78 in the lever 77, it is possible to adjust the position of the lever 77 with respect to its parallelism or its position relative to the supporting surface 41. The free end of the lever 77 is profiled with a step-formed cutout 79. With this construction there result two shanks 80, 81 pivotally receiving a shaft 82. The latter extends with one end out of the lever 77 towards the front side of the sewing machine 1. On this overhanging end a double-armed lever 83 is pivotally received. According to FIG. 2 and 9, this double-armed lever 83 is axially secured on the shaft 82 by a retaining ring 84. One arm 85 of the lever 83 extends towards the supporting surface 41. At its end there is arranged a bolt 86 situated parallel with respect to the shaft 82. The other arm 87 of the lever 83 terminates in a fork 88. The end of the arm 85 including the bolt 86 extends into a cross-profiled cutout 89 of a first stop member 90 (FIG. 14). As evidence from FIG. 17, the end of the arm 85 reaches with clearance into the cross-profiled cutout 89 as the bolt 86 is surrounded at its lower portion of circumference by a cutout zone 91. Due to the construction of the cutout 89 as described, the cutout zone 91 and the end of the arm 85 form a pivot connection 92.

The fork 88 of the other arm 87 embraces a bolt 93, which is formed with an reinforced shoulder (not shown) and which firmly extends through a lever 94. According to FIGS. 2, 3 and 9 on the overhanging end 95 of the bolt 93, there is pivotally received a connecting part 96 axially secured by a retaining ring 97. The connecting part 96 is firmly connected to a piston rod 98 of a stop positioning drive 99. The latter is constructed as a single-acting pneumatic cylinder having in its interior at the side of the piston rod 98, an integrated compression spring, so that the pneumatic cylinder without any supply of pressurized air assumes a position, in which the piston rod 98 is retracted. At the lever 77 there is formed a bearing web 100, to which is pivoted the free end of the stop-positioning drive 99 by a bolt 101. The retracted position of the stop positioning drive 99 as described above is illustrated in FIGS. 1, 3, 4, 8, 9 and 17. With the retracted position, the first stop member 90 will be kept in a position according to FIG. 8, wherein it assumes a position closest to the needle 27.

Details of the first stop member 90 become evident from FIGS. 8, 14 and 15. From a middle section 102 there extends a wall 103, which extends parallel with respect to the supporting surface 41 according to FIG. 8. The wall 104 extends from the middle section 102 towards the front side of the sewing machine 1. At the wall 104 there is fastened a light barrier 105. The latter has a light-emitting and a light-receiving point 106 and is connected to the control 54 via a leader 107. The wall 103 terminates in three stop fingers 108, 109 and 110, which extend parallel to the needle 27 in accordance with FIG. 8. From the middle section 102, there further extends, under a slight angle in the direction away from the supporting surface 41, an upwardly bent lever-profiled part 111. The first stop member 90 rests with its weight on the supporting surface 41 of the base plate 2, so that the stop fingers 108, 109, 110 come in contact with the upper surface of the throat plate 24. In this position the stop finger 108 penetrates through the cutout of the sole 40. Due to the pivot connection 92, the first, stop member 90 is kept in the plane of the supporting surface 41. At the lever 77 there is arranged a lift drive 112 in form of a single-acting pneumatic cylinder. The latter has an integrated compression spring, which causes the lift drive 112 to assume a position of no pressurized air supply, so that the piston rod 113 assumes its retracted position according to FIG. 8. The free end of the piston rod 113 is furnished with a mushroom-formed press piece 114, which cooperates drivably with the lever-profiled part 111 of the first stop-member 90.

Figure 3:
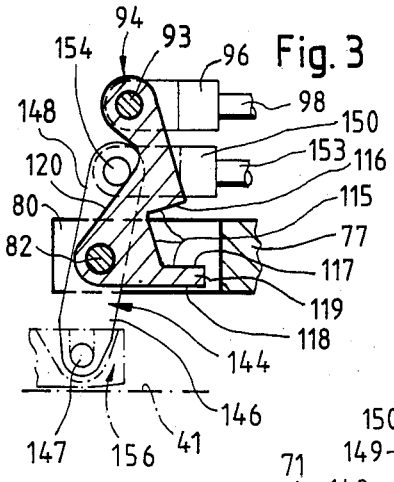
FIG. 3 is a sectional view taken along section III—III in FIG. 2.

As evidence from FIG. 3, the lever 94 drivingly connected to the stop positioning drive 99, has a cutout 115, which is limited by an edge 116 and an upper top edge 117. The latter limits a stem 119 in conjunction with a lower stop edge 118. Moreover, the lever 94 is profiled at its circumference-zone with a control edge 120.

Figure 5:
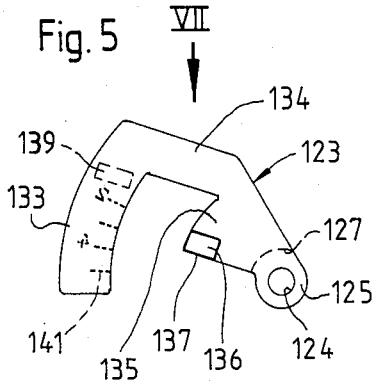
FIG. 5 is a projection of a separate part in accordance with FIG. 4.
Figure 6:
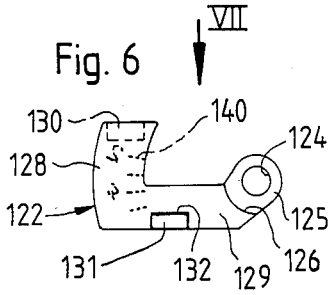
FIG. 6 is a projection corresponding to FIG. 4 showing an individual part.
Figure 7:
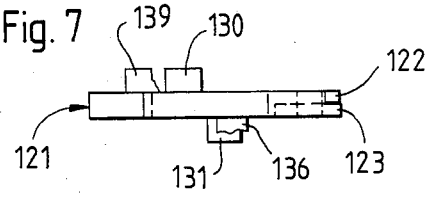
FIG. 7 is a top plan view of the parts shown in FIGS. 5 and 6 shown as an assembly according to the arrow VII in FIGS. 5 and 6.

According to FIG. 9 the lever 77 is provided in the zone of the cutout 79, with a further cutout 79', which receives tiltably with clearance a pair of adjustment levers 121 carried by shaft 82. The pair of adjustment levers 121 are formed by a lower adjustment lever 122 (FIG. 6) and an upper adjustment lever 123 (FIG. 5). Both adjustment levers 122, 123 are formed with a bearing 125 provided with a bearing bore 124. According to FIG. 7, the bearings 125 are each formed with the half thickness of the adjustment levers 122, 123, which becomes obvious by an arc-formed edge 127 in accordance to the FIGS. 5 and 6. Moreover, the lower adjustment lever 122 is profiled with an annular zone 128, which is connected with the bearing 125 via a stem 129. At the free end of the annular zone 128, there is formed an adjustment projection 130. Moreover, the lower adjustment lever 122 is profiled with a stop 131. A stop edge 132 is furnished at the stem 129.

The upper adjustment lever 123 shown in FIG. 5, is similar to the lower adjustment lever 122 formed with an annular zone 133 connected to the bearing 125 via a stem 134. Between the bearing 125 and the stem 134, there is still formed a sector 135 at which a stop 136 with a stop edge 137 are provided. Moreover, at the annular zone 133, there is profiled an adjustment projection 139. Due to the previously-described special construction of the adjustment levers 122, 123, it is possible to fit the latter into each other according to a manner of a pair of scissors, as this is evident from FIG. 7. According to FIGS. 5 and 6, the adjustment levers 122, 123 are each marked at the back side with an adjustment scale 140, 141. In FIG. 8 the lower 122 and the upper adjustment lever 123 are adjusted that the scale 141 of the upper adjustment lever 123 is visible. As further evident from FIGS. 8 and 9, in the shank 81 of the lever 77, there are screwed in two securing screws 142, 143. These serve for locking the lower 122 and the upper adjustment lever 123, and for this purpose they clampingly act on the annular zones 128, 133.

Due to the arrangement of the lever 94 next to the pair of adjustment levers 121, the stops 131, 136 reach in the plane of the stem 119 of the lever 94. Due to this fitting of one part into the other part, the tilt movement generated by the stop positioning drive 99 and imparted to the double-armed lever 83, is limited in its most extreme positions, wherein the upper and lower stop edge 117, 118 of the stem 119 abut the stop edges 137, 132.

According to FIGS. 2, 9 and 16 on the shaft 82, there is further arranged a double-armed lever 144 secured by a set screw 145. By the arrangement of the double-armed lever 144 together with the lever 94 and the pair of adjustment levers 121 in the cutout 79 of the lever 77, the aforementioned elements are independently movable and axially secured on the shaft 82. According to FIG. 3, the double-armed lever 144 is formed with an arm 146 extending towards the supporting surface 41 of the base plate 2. Similar to the arm 85 of the double-armed lever 83, the arm 146 is furnished with a symmetrical pressed-in bolt 147. The other arm 148 of the double-armed lever 144 is pivotally connected to a connecting part 150 by a bolt 149. The connecting part 150 is axially guided by a retaining ring 151. A stop positioning drive 152 corresponding structurally to the stop positioning drive 99, is also movably connected to the bearing web 100 by a bolt formed also like the bolt 101. The stop positioning drive 152 is provided with a piston rod 153, to which the connecting part 150 is fastened. According to FIG. 2 the bolt 149 extends with a free end 154 into the operating range of the lever 94, so that the end 154 can come into contact with the control edge 120 of the lever 94, according to a kind of a striker.

In a similar manner as the first stop member 90 is drivingly connected to the double-armed lever 83, the arm 146 of the double-armed lever 144 is drivingly connected with a second stop member 156 via a pivot connection 155. For this purpose, the second stop member 156 is, similar to the first stop member 90, formed with a cross-profiled cutout 157 as evidence from FIGS. 11 and 12. The second stop member 156 has a middle area 158 surrounding the cross-profiled cutout 157. The middle area 158 is formed with a surface 159 extending to the supporting surface 41 of the base plate 2. According to FIG. 12, this surface 159 terminates in an arc-formed part 160. At the end of this arc-formed part 160, there is formed an edge 161 limiting the middle area 158. From the latter extends a wall 162, which is perpendicular to the same and at which are provided finger-formed stop fingers. The finger-formed stop fingers extend through the cutouts 42 of the sole 40, as shown in principle in FIG. 16 where only one visible finger 166 is illustrated. The finger ends come into contact with the supporting surface 41 or the throat plate 24. According to FIG. 16 on the supporting surface 41, a stop 168 is fastened by screws in the zone of displacement of the second stop member 156. The stop 168 comes into contact with the second stop member 156 in a shifted position in a manner to be described.

The operation procedure of the invention is as follows:

It is assumed that prior to the operation procedure, the needle 27 of the sewing machine 1 is positioned in its upper position; the presser foot 30 is in a lifted position due to the actuation of the lift drive; and the plates 58, 59 of the turning device 57 are positioned into their lifted positions due to the corresponding actuation of the tilt drive 68, and as illustrated by dot-dash lines in FIG. 1. Moreover, it is assumed that prior to operation, the lift drive 122 is not supplied with compressed air—as this is shown in FIG. 8—and that the stop positioning drive 99 assumes a position in which its piston rod 98 is retracted, so that the first stop member 90 assumes the illustrated position shown in FIGS. 8 and 18*a*. This position is determined by the setting of the lower adjustment lever 122, whereby the lower stop edge 118 of the lever 94 comes into contact with the stop edge 132 of the lower adjustment lever 122. Moreover, it is assumed that the second stop member 156 has assumed a position as illustrated by a dot-dash lines in FIG. 16. This is achieved by a corresponding actuation of the stop positioning drive 152. At this point, the latter has extended its piston rod 153, so that the second stop member 156 has assumed a position away from the needle 27 and finally has been lifted up due to the contact action of the edge 161 with the stop 168. The lifting of the second stop member 156 is thus achieved by a lift drive, which is formed by the stop positioning drive 152 and the stop 168 or the edge 161. The previously-described initial condition of the sewing machine is illustrated in FIG. 18*a*.

Figure 4:
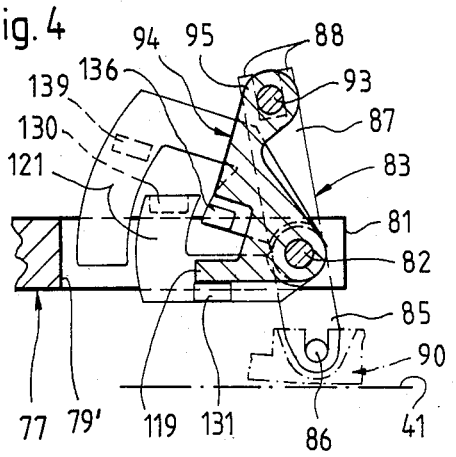
FIG. 4 is a sectional view taken along section IV—IV in FIG. 2.

In this condition, a workpiece 25 in form of a one-piece collar according to FIG. 18*a*, is placed on the supporting surface 41 of the base plate 2. The stop fingers 108, 109 and 110 serve as a stop of one shank 170 of the workpiece 25. Due to the setting of the lower adjustment lever 122 the dimension "a" represents a minimum distance, with which a seam 171 can be produced in the workpiece 25 according to the extension of a line 172. This final position of the lower adjustment lever 122 is thus achieved as the adjustment projection 130 serving for manual adjustment, gets close or comes in contact with the lever 77 as shown in FIG. 4. The insertion of the workpiece 25 according to FIG. 18*a*, is made possible without difficulty, since a projecting zone 173 (beak of a collar) can be placed unobstructed under the second stop member 156, which is positioned away from the needle 27 and lifted up with respect to the throat plate 24.

After the actuation of a start push-button (not shown), the control 54 actuates at first the lift drive for the presser foot 30 and the tilt drive 68 of the turning device 57 reversingly. The presser foot 30 and the plates 58, 59 will thereby be lowered onto the workpiece 25, so that the latter will be placed directly above the workpiece 25. In this position, the plate 59 does not come into contact with the workpiece 25. Upon rotation of the arm shaft 6, the shaft 16 will be oscillatingly driven via the stitch length regulating fork 11. Simultaneously, due to the kinematic connection, the cranks 52 and 50 connected with the interposed overrunning element shaft 49, will be thereby intermittently driven. This intermittent motion is transferred to the timing belt 33, which now imparts a feed movement in direction of the arrow 174 (FIG. 10) in conjunction with the feed dog 22 acting intermittently upon the workpiece 25 by intermittently extending through the cutout 23 of the throat plate 24. At this point, the especially tapered formed sole 40 serves for the running of the workpiece 25 into the zone of stitch formation of the sewing machine 1. As soon as one of the light barriers 56 has detected a predetermined feed distance of the workpiece 25, i.e. after a short portion of the seam 171 according to the extension of the line 172 in the zone of the shank 170 has been sewn, the control 54 causes a switchover of the stop positioning drive 152. As a result, the second stop member 156 will be displaced into a position nearest to the needle 27 as illustrated by solid lines in FIG. 17. In this position, now, all stop fingers 108–110 and 163–166 serve for the guidance of the workpiece 25 for the generation of the edge-parallel seam 171.

After the seam 171 in the shank 170 has been generated up to the corner point 175, the control 54 causes, because of optical detection of this corner point 175 by one of the light barriers 56, that the drive of the sewing machine 1 will be stopped with the needle 27 in its lowest position within the workpiece 25. Subsequently, the control 54 causes activation of the lift drive in order to lift off the presser foot 30 from the workpiece 25. Simultaneously, the control 54 causes a withdrawal or removal of the second stop member 156 into the position shown in FIG. 18*b*. This is achieved by a corresponding actuation of the stop positioning drive 152. Due to this control, the first and the second stop member 90, 156 will be positioned relatively to each other positioned as described in a preceding part of this description related to the insertion of the workpiece 25 in connection with FIG 18*a*. The relocation of the second stop member 156 makes possible an unobstructed turning of the workpiece 25 about the needle 27, so that collision between the workpiece tip 190 and the second stop member 156 is prevented. After run-off of a certain period of dwell, which is required in order to relocate and lift up the second stop member 156, as described, the control 54 produces a further supply of compressed air to the turning device 57, so that due to exhausting air out of the outlet openings 62, a turning of the workpiece 25 about the needle 27 positioned in its lowest position within the workpiece 25 in a direction of the arrow 70 is achieved. The completion of the turning of the workpiece 25 will be detected by one of the light barriers 56 and indicated via a signal to the control 54, so that a further edge 176 of the workpiece 25 comes into contact with the non-relocated stop fingers 108, 109, 110 of the first stop member 90. Subsequently, the control 54 causes a lowering of the presser foot 30 and a relocating of the second stop member 156, so that the sewing machine 1 can continue generating the seam 171 along a line 177. After the completion of the seam 171 along the line 177 finally, there follows a turning again of the workpiece 25 about the needle 27 which is brought to a standstill and into its lowest position. At this point, the control 54 corresponding controls again the lift drive and the stop positioning drive 152 in the afore-described manner. In principle, the turning of the workpiece 25 is again accomplished according to the illustration of FIG. 18*b*.

Subsequently, the completion of the turning will again be detected by one of the light barriers 56, so that the sewing machine 1 will be ready once more for sewing. Finally, the seam 171 should be completed in a further shank 178. As soon as the workpiece 25 has approximately reached the position with respect to the sewing machine 1 as shown in FIG. 18*c*, the light barrier 105 detects via its point 106 the presence of a further projecting zone 179, which is profiled at collars in a mirror-image arrangement relative to the projecting zone 173. In this position of the workpiece 25, a corner 180 is still located at sufficient distance away from the stop finger 110, so that enough time remains whereby the control 54 can initiate a lifting of the first stop member 90, even though the continuation of the generation of the seam 171 along the line 181 is carried out. At this point, the first stop member 90 assumes the position shown by dash-dotted lines in FIG. 17, wherein the first stop member 90 has basically not been relocated away from the needle 27. This is achieved since the first stop positioning drive 99 remains unaltered in its shift position and since the lift drive 112 is correspondingly actuated. The actuation of this drive effects that the mushroom-formed press piece 114 presses on the lever-profiled part 111 of the first stop member 90, and thereby lifts the associated stop fingers 108, 109, 110.

In this condition, the workpiece 25 will be further fed in the direction of the arrow 174, until the needle 27 reaches approximately a point 182 on the line 181. Reaching of the point 182 again will be recognized by the impulse output of the light barrier 56. Subsequently, the control 54 triggers an off-and-up tilting of the second stop member 156, so that the latter assumes the position illustrated by dash-dotted lines in FIG. 16. The remaining amount of the seam 171 to be produced along the line 181 up to the point 183, is accomplished by the sewing machine 1 without the assistance of the stop fingers 108–110 and 163–166 guiding the outer edge of the workpiece 25. As soon as the point 183 is reached, the control 54 can still trigger a reversion of the elements (feed dog 22, timing belt 33) acting upon the workpiece 25 with corresponding construction of the sewing machine 1, in order to produce a backtack securing the seam 171. A similar process can also be provided at the start of the seam 171 for securing the initial point of the seam 171.

In contrast to the workpiece 25, a workpiece 184 according to FIG. 19 can be formed, due to fashional influence, so that an angle W enclosed by a projecting zone 185 and a shank 186 assumes a value less than 90°. With such a workpiece and more or less acute angle W, a line 187 can be drawn as a tangent of the projecting zone 185, on one hand, and as a normal at the shank 186, on the other hand, so that a triangle 188 is formed. The latter is shown shaded in FIG. 19. Due to these geometric conditions, it would be possible, only with considerable difficulties, to sew the workpiece 184 only with parallel displaceable stop members, since the workpiece 184, as already described, would then be left to itself over a relative large distance without any guidance at the stop members during sewing of the final zone of the seam.

The sewing machine 1, according to the present invention, furthermore, makes it possible to generate edge-parallel seams in a workpiece in form of a one-piece collar, which has the characteristics of the afore-described projecting zones. A seam 189 illustrated additionally in FIG. 19 besides the seam 171, represents an equidistant curve of the latter and can be produced in a distance "b" away from the edge of the shank 186. For the generation of such a seam 189 in addition to the seam 171, the control 54 provides, at corresponding adjustment of the program selecting switch 55, that both stop members 90, 156 in accordance to the distance "b," will be relocated into a position away from the needle 27. This position of both stop members 90, 156 is shown in FIGS. 16 and 17, wherein the associated stop fingers are illustrated by dashed lines. The positions are achieved so that the stop positioning drive 99 alone, is actuated whereby the double-armed lever 83 will be tilted opposite to he clockwise direction and into a position illustrated with dashed lines in FIG. 17. By the withdrawal of the end 154 of the bolt 149 of the control edge 120 of the lever 94, the second stop member 156 coupled to the lever 144 will be also displaced in the same manner as the first stop member 90.

The designated distances "a" and "b" can assume size values between 1 and 8 millimeters. These distances are made variable by an adjustment of the lower and upper adjustment lever 122, 123. For a given setting, at first the securing screws 142, 143 will be loosened and subsequently the individual adjustment levers 122, 123 will be adjusted with assistance of the adjustment projections 130, 139 that are provided. At this setting procedure, the associated scales 140, 141 serve to facilitate this action. In a way that the relocation of the lower adjustment lever 122 serves for altering the distance "a," the upper adjustment lever 123 is provided to vary the distance "b." After setting the desired distances "a" and "b", the adjustment levers 122, 123 will be secured against undesired relocation by locking the securing screws 142, 143.

Finally, it may be expressively pointed out that the stop fingers 108 to 110 and 163 to 166 come in contact with the outer contour or the outer edges of the workpiece to be sewn, in order to guide the latter during the sewing process. For explaining better FIGS. 18*a* to *c*, there is purposely illustrated a play, which in reality does not exist.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention, and therefore, such adaptations should and are intended to be comprehended within the meaning and range of equivalence of the following claims.

What is claimed is:

1. A sewing machine for producing an edge-parallel seam in a workpiece, comprising:

a supporting surface and a presser foot for said workpiece;

a stitching needle;

feeding means for advancing said workpiece in a feed direction relative to said needle; and edge-guide means for said workpiece arranged in a proximate area of said needle and laterally to said needle with respect to said feed direction;

said edge-guide means comprising:

a first stop member arranged in front of said needle with respect to said feed direction; and a second stop member arranged behind said needle with respect to said feed direction;

said first and said second stop members being each relocatable into several positions, in said positions at least one of said first and second stop member is additionally liftable into a lifted position with respect to said supporting surface; said edge guide means comprising further a lift drive for said liftable edge stop member; said lift drive comprising drive means relocating said liftable edge stop member and a stop coming into engagement with said edge stop member when being relocated to its relocated position.

2. A sewing machine for producing an edge-parallel seam in a workpiece, comprising:

a supporting surface and a presser foot for said workpiece;

a stitching needle;

feeding means for advancing said workpiece in a feed direction relative to said needle; and edge-guide means for said workpiece arranged in a proximate area of said needle and laterally to said needle with respect to said feed direction;

said edge-guide means comprising:

a first stop member arranged in front of said needle with respect to said feed direction; and a second stop member arranged behind said needle with respect to said feed direction;

said first and said second stop members being each relocatable into several positions, in said positions at least one of said first and second stop member is additionally liftable into a lifted position with respect to said supporting surface; each of said stop members having an individual lift drive.

3. A sewing machine for producing an edge-parallel seam in a workpiece, comprising:

a supporting surface and a presser foot for said workpiece; a stitching needle;

feeding means for advancing said workpiece in a feed direction relative to said needle; and edge-guide means for said workpiece arranged in a proximate area of said needle and laterally to said needle with respect to said feed direction;

said edge-guide means comprising:

a first stop member arranged in front of said needle with respect to said feed direction; and a second stop member arranged behind said needle with respect to said feed direction;

said first and said second stop members being each relocatable into several positions, in said positions at least one of said first and second stop member is additionally liftable into a lifted position with respect to said supporting surface; said edge guide means comprising further a lift drive for said liftedge stop member; said lift drive comprising a pneumatic cylinder, and drive means relocating said liftable edge stop member and a stop coming into engagement with said edge stop member when being relocated to its relocated position.

4. A sewing machine for producing an edge-parallel seam in a workpiece, comprising:

a supporting surface and a presser foot for said workpiece;

a stitching needle;

feeding means for advancing said workpiece in a feed direction relative to said needle; and edge-guide means for said workpiece arranged in a proximate area of said needle and laterally to said needle with respect to said feed direction;

said edge-guide means comprising:

a first stop member arranged in front of said needle with respect to said feed direction;

a second stop member arranged behind said needle with respect to said feed direction;

said first and said second stop members being each relocatable into several positions; and a lift drive for additionally lifting at least one of said first and second stop members, into a lifted position with respect to said supporting surface for producing an edge parallel stitching in a workpiece having a projecting area wherein said projecting area may pass unobstructingly under said at least one of said first or second stop member 5. A sewing machine according to claim 4, wherein said stop member that is lifted into said lifted position comprises a link connection for pivoting said stop member at said sewing machine.

6. A sewing machine according to claim 5, wherein said link connection comprises a tilt axle arranged in parallel to said supporting surface.

7. A sewing machine according to claim 6, wherein said tilt axle extends parallel to said feed direction.

8. A sewing machine according to claim 4, wherein said lift drive comprises a pneumatic cylinder.

9. A sewing machine according to claim 8, wherein said lifted edge stop member comprises a lever-profiled part coacting with said lift drive.

10. A sewing machine according to claim 8, wherein said lift drive comprises drive means relocating said lifted edge stop member and a stop coming into engagement with said edge stop member when being relocated to its relocated position.

11. A sewing machine according to claim 4, wherein said lifted edge stop member comprises a lever-profiled part coacting with said lift drive.

12. A sewing machine according to claim 4, wherein said lift drive comprises drive means relocating said lifted edge stop member and a stop coming into engagement with said edge stop member when being relocated to its relocated position.

13. A sewing machine according to claim 4, wherein each of said stop members has an individual lift drive 14. A sewing machine according to claim 13 for sewing a shirt collar, wherein said sewing machine further comprises:

light barrier means detecting edges of shirt collars; and control means cooperating with said light barrier means for controlling said positions of said relocatable edge stop members and said lift drives.

15. A sewing machine for producing an edge-parallel seam in a workpiece, comprising:

a supporting surface and a presser foot for said workpiece;

a stitching needle;

feeding means for advancing said workpiece in a feed direction relative to said needle; and edge-guide means for said workpiece arranged in a proximate area of said needle and laterally to said needle with respect to said feed direction;

said edge-guide means comprising:

a first stop member arranged in front of said needle with respect to said feed direction;

a second stop member arranged behind said needle with respect to said feed direction;

said first and said second stop members being each relocatable into several positions; and a lift drive for additionally lifting at least one of said first and second stop members into a lifted position with respect to said supporting surface, said lift drive comprising a pneumatic cylinder and drive means relocating said liftable edge stop member and a stop coming into engagement with said edge stop member when being relocated to its relocated position.

* * * * *